US007089697B2

(12) United States Patent
Monks

(10) Patent No.: US 7,089,697 B2
(45) Date of Patent: Aug. 15, 2006

(54) TRIGGER TRANSITION FILTER FOR A PAINTBALL MARKER

(75) Inventor: Steven John Monks, Manchester (GB)

(73) Assignee: Planet Eclipse Limited, Manchester (GB)

( * ) Notice: Subject to any disclaimer, the term of this patent is extended or adjusted under 35 U.S.C. 154(b) by 46 days.

(21) Appl. No.: 11/030,473

(22) Filed: Jan. 5, 2005

(65) Prior Publication Data

US 2005/0155589 A1 Jul. 21, 2005

Related U.S. Application Data

(60) Provisional application No. 60/534,563, filed on Jan. 6, 2004.

(51) Int. Cl.
*F41A 19/24* (2006.01)
*F41A 19/58* (2006.01)

(52) U.S. Cl. ..... 42/69.01; 42/84; 89/129.01; 89/135; 89/136; 124/32

(58) Field of Classification Search ..... 42/69.01, 42/84; 89/129.01, 129.02, 135, 136; 124/32, 124/77

See application file for complete search history.

(56) References Cited

U.S. PATENT DOCUMENTS

| | | | | |
|---|---|---|---|---|
| 4,106,074 | A * | 8/1978 | Conne | 361/248 |
| 4,109,557 | A * | 8/1978 | Zaucha | 89/7 |
| 4,256,013 | A * | 3/1981 | Quitadama | 89/41.05 |
| 4,495,848 | A * | 1/1985 | Rozner et al. | 89/1.1 |
| 5,303,495 | A * | 4/1994 | Harthcock | 42/84 |
| 5,575,269 | A * | 11/1996 | Harklau | 124/35.2 |
| 5,727,538 | A | 3/1998 | Ellis | 124/77 |
| 5,890,479 | A | 4/1999 | Morin | 124/31 |
| 5,937,558 | A * | 8/1999 | Gerard | 42/84 |
| 6,123,007 | A * | 9/2000 | O'Dwyer | 89/135 |
| 6,142,137 | A | 11/2000 | MacLaughlin | 124/72 |
| 6,311,682 | B1 | 11/2001 | Rice et al. | 124/71 |
| 6,615,814 | B1 | 9/2003 | Rice et al. | 124/71 |
| 6,644,296 | B1 | 11/2003 | Gardner, Jr. | 124/77 |
| 6,748,938 | B1 | 6/2004 | Rice et al. | 124/77 |
| 6,763,822 | B1 | 7/2004 | Styles | 124/77 |
| 6,785,996 | B1 * | 9/2004 | Danner et al. | 42/70.08 |
| 6,941,693 | B1 * | 9/2005 | Rice et al. | 42/71.01 |
| 6,948,487 | B1 * | 9/2005 | Rice et al. | 124/32 |
| 6,966,313 | B1 * | 11/2005 | Yokota et al. | 124/32 |

FOREIGN PATENT DOCUMENTS

| | | |
|---|---|---|
| JP | 1179898 | 7/1989 |
| JP | 3207998 | 9/1991 |

* cited by examiner

*Primary Examiner*—Michael J. Carone
*Assistant Examiner*—Bret Hayes
(74) *Attorney, Agent, or Firm*—Barlow, Josephs & Holmes, Ltd.

(57) ABSTRACT

A method of preventing trigger bounce during the launching of a projectile by a projectile launcher includes the step of first providing a projectile launcher having a trigger capable of actuating between a full non-firing position and a full firing position. An amount of time is determined for the trigger to normally transition from a full non-firing position to a full firing position. A sensor, such as an analog optical sensor, is used to sense position of the trigger. If the time for the trigger to transition from a non-firing position to a firing position exceeds the time for the trigger to normally transition from a full non-firing position to a full firing position, launch of the projectile is delayed period of time requiring the trigger to be release to a full non-firing position.

14 Claims, 8 Drawing Sheets

| TIME | VALUE |
|---|---|
| $t_0$ | VAL 0 |
| $t_1$ | VAL 1 |
| $t_2$ | VAL 2 |
| $t_3$ | VAL 3 |
| $t_n$ | VAL n |

FIG. 5

TRIGGER TRANSITION FILTER FOR A PAINTBALL MARKER

CROSS-REFERENCE TO RELATED APPLICATION

This application is related to and claims priority from earlier filed provisional patent application Ser. No. 60/534,563, filed Jan. 6, 2004.

BACKGROUND OF THE INVENTION

The invention relates generally to paintball markers and other projectile launching devices. The present invention relates to the assembly, operation and control of a trigger of a projectile launcher, such as a paintball marker, and the firing of projectiles therefrom. The present invention particularly relates to the launching of a projectiles in an electronic paintball marker and other such devices.

The present invention relates to any type of projectile launcher, such as a paintball marker or firearm. For ease of discussion herein, this description relates solely to paintball markers and the control of triggers therein. However, it should be understood that the present invention is applicable to any type of projectile launcher and the scope of the present invention and the claims herein are intended to cover such projectile launchers other than paintball launchers.

However, it is also well known that it is possible, on only one pull or a partial pull of the trigger, a marker can operate automatically, i.e. firing multiple paintballs without fully releasing the trigger or fully pulling the trigger. This is known as "trigger bounce" in the paintball and weapon industries. Trigger bounce can occur in markers that have mechanical or electrical triggers.

In markers that have mechanical triggers, a trigger is pulled to open a pneumatic valve via a mechanical linkage to release a burst of air from an air supply to launch the paintball through the marker barrel. Such operation is well known in the art and need not be discussed in further detail herein.

As seen in the prior art paintball marker 10 of FIG. 1, main body 12 is provided with a barrel 14 for launching the paintball 16. A trigger 18 typically is positioned in the grip frame portion 20 of the marker 10. When the trigger 18 is pulled just enough to launch the paintball 16 and the trigger 18 is held in such a position, the mechanical recoil of the marker 10 can force the trigger 18 back into the finger of the user without another pull of the trigger 18 resulting in the immediate launching of another paintball 16. As long as the trigger 18 is held in the partially pulled positioned and the marker 10 is balanced appropriated, the marker 10 can be easily be operated in automatic launching mode to launch paintballs 16 in successive fashion.

Such trigger bounce can also occur in triggers 18 that use electronic sensors or electronic switches to determine trigger position. Such electronic sensors (not shown in FIG. 1) can be analog or digital. For example, an analog sensor can be an optical sensor that passes a portion of the trigger in front of a light emitter and light receiver or a Hall Effect inductive device that uses magnet or ferrous material and a coil to measure distance of trigger travel.

By way of example, a trigger equipped with an optical sensor 22 is shown in FIG. 2 to illustrate trigger bounce in such an electronic environment. Trigger 18 pivots on a pin 24 that passes through the body of the grip frame 20. The trigger 18 is held onto the pin 24 by means of a set screw 26. A second set screw 28 is positioned in a threaded hole 30 through the front of the trigger 18 and acts as a trigger stop. This set screw 28 can be screwed into or out from the hole 30 in order to vary the maximum travel of the trigger 18. A third set screw 32 locates in a threaded hole 34 through the top of the trigger 18 and also acts as a trigger stop. This set screw 32 can be screwed into or out from the hole 34 in order to vary the rest position of the trigger 18. A small magnet 36 is located in the grip frame 20 above a fourth set screw 38. This magnet 36 attracts the set screw 38, ensuring that the trigger 18 returns to its rest position when released.

Most importantly, a prong 40 protrudes from the rear of the trigger 18 passing through a slot in the grip frame 20. When the trigger 18 is operated the prong 40 passes through a slotted optical sensor 22, having a light emitter 22*a* and a light receiver 22*b*. More specifically, light emitter 22*a* emits light toward light receiver 22*b*. When the light receiver 22*b* senses the full strength of the light emitted from light emitter 22*a*, a non-firing position can be indicated. When the prong 40 completely blocks the light receiver 22*b*, a firing position can be indicated.

A typical optical sensor 22 used in a paintball marker 10 has a 1.2 millimeters diameter view. Thus, a trigger stroke length of 1.2 millimeters can be monitored. Different optical sensors with different diameters can be used and still be within the scope of the present invention. It should also be understood that the trigger construction of FIG. 2 is just one example of how a an optical sensor 22 can be used to monitor trigger position.

Also, a threshold level can be set so that when the trigger 18 blocks a certain amount of light to the light receiver 35*b*, a firing position can also be indicated. Such a threshold can be set anywhere from 0 to 100 percent light blockage but it is typically in the range of 40–60 percent light blockage to indicate a firing condition. Therefore, the optical sensor 22 can detect trigger position along its path of travel.

In this example that employs an optical sensor 22 to sense trigger position, trigger bounce occurs when the trigger 18 is partially pulled and cycles slowly between a position just above and just below the threshold level for triggering. The resultant recoil of the marker 10 during the physical firing and movement of the bolt therein (not shown) causes the trigger 18 to move between the two aforementioned positions resulting in the marker 10 operating in a simulated automatic mode of operation.

Thus, it is very common in the use of paintball markers 10 to exploit the recoil of the marker during firing while holding the trigger 18 down to enable the marker 10 to fire automatically without pulling the trigger 18 again. The firing of multiple paintballs 16 from only a single pull of the trigger 18 is highly undesirable as it contravenes typical paintball competition rules. While players are penalized for such rules infractions, trigger bounce is still exploited during game play.

In view of the foregoing, there is a need for a way to enforce paintball rules that prohibit automatic firing by exploiting trigger bounce. There is a further need to control the operation of the paintball marker itself to ensure that a single trigger pull results in only one paintball being fired.

SUMMARY OF THE INVENTION

The present invention preserves the advantages of prior art trigger systems for paintball markers. In addition, it provides new advantages not found in currently available trigger systems and overcomes many disadvantages of such currently available systems.

The invention is generally directed to the novel and unique method of preventing trigger bounce during the launching of a projectile by a projectile launcher, such as a paintball marker. The method of the present invention includes the step of first providing a projectile launcher having a trigger capable of actuating between a full non-firing position and a full firing position. An amount of time is determined for the trigger to normally transition from a full non-firing position to a full firing position. A sensor, such as an analog optical sensor, is used to sense position of the trigger. If the time for the trigger to transition from a non-firing position to a firing position exceeds the time for the trigger to normally transition from a full non-firing position to a full firing position, launch of the projectile is followed by an enforced time delay during which no subsequent projectile launches can occur while requiring that the trigger be released to a full non-firing position.

It is therefore an object of the present invention to provide a method of controlling the firing operation of a paintball marker.

It is an object of the present invention to provide a method for controlling the operation of the trigger in a paintball marker.

It is a further object of the present invention to provide a method of monitoring the position of the trigger in a paintball marker.

Another object of the present invention is to provide a method for preventing trigger bounce in a paintball marker that employs an analog sensor to monitor trigger position.

It is a further object of the present invention to provide a method to prevent trigger bounce from permitting a non-automatic paintball marker from operating in an automatic firing mode.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

FIG. 5 is a table of the data graphed in FIG. 3;

DETAILED DESCRIPTION OF THE PREFERRED EMBODIMENT

Figure 1:
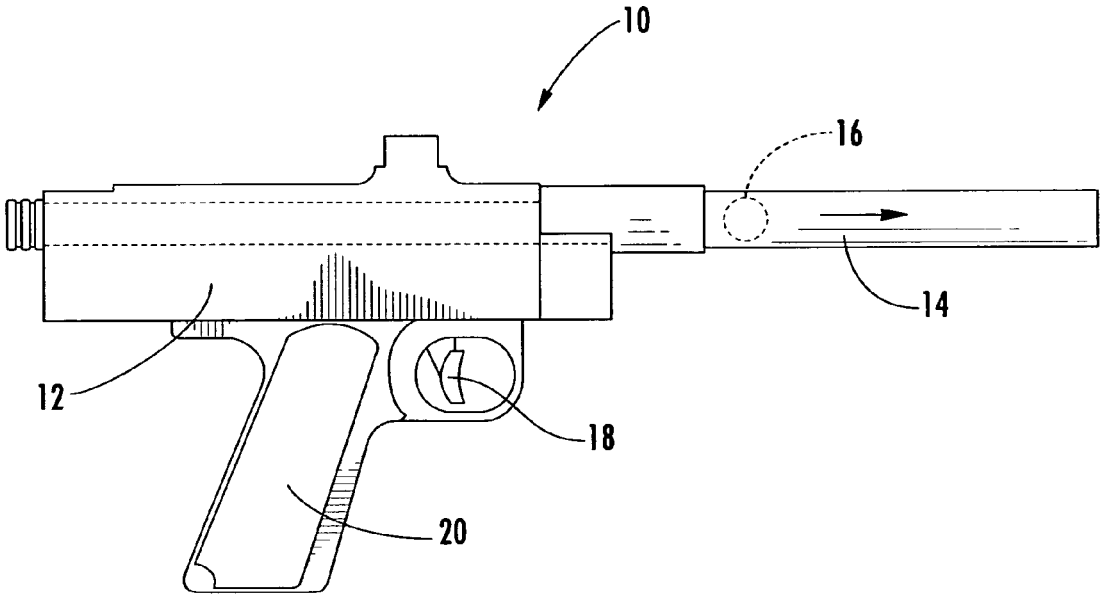
FIG. 1 (PRIOR ART)
FIG. 1 is side view of a prior art paintball marker.
Figure 2:
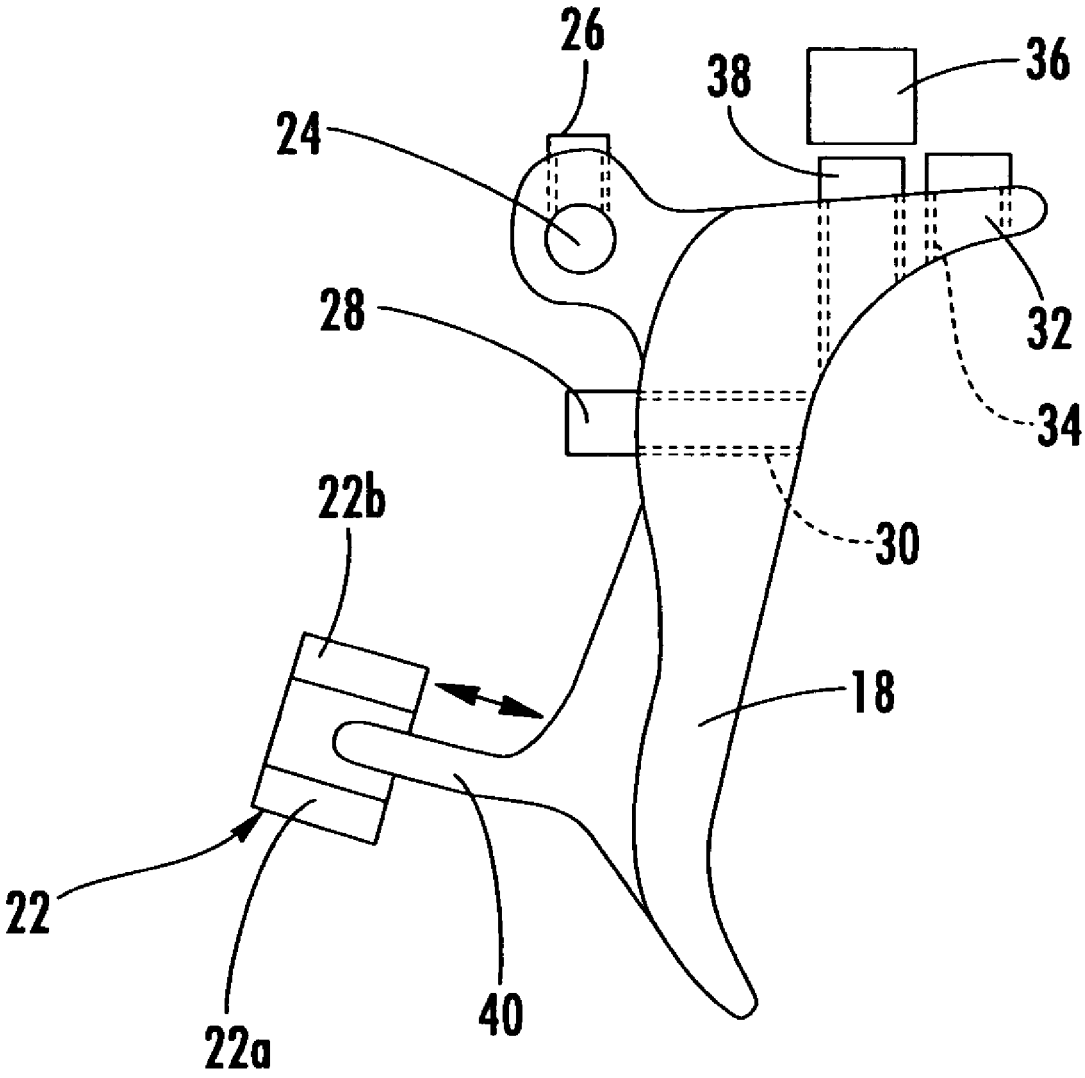
FIG. 2 (PRIOR ART)
FIG. 2 is a side view of a prior art trigger assembly that uses an analog optical sensor to monitor trigger position.

The prior art operation of an analog sensor 22, such as an optical sensor, to control triggering in a paintball marker 10 is discussed in detail in connection with FIGS. 1 and 2 above. FIGS. 3–7 below discuss in detail the monitoring and filtering of such an analog sensor 22 to prevent unwanted automatic mode firing due to trigger bounce exploitation. In the prior art, analog sensors 22 are merely used as ON/OFF sensors where a certain threshold is met to indicate a given position of the trigger 18. As will be discussed in detail below, the present invention uses the analog sensor 22 and all of the analog data supplied by it, including partial measurement of trigger 18 travel, to detect and then stop a trigger 18 bounce operation of a marker 10.

Figure 3:
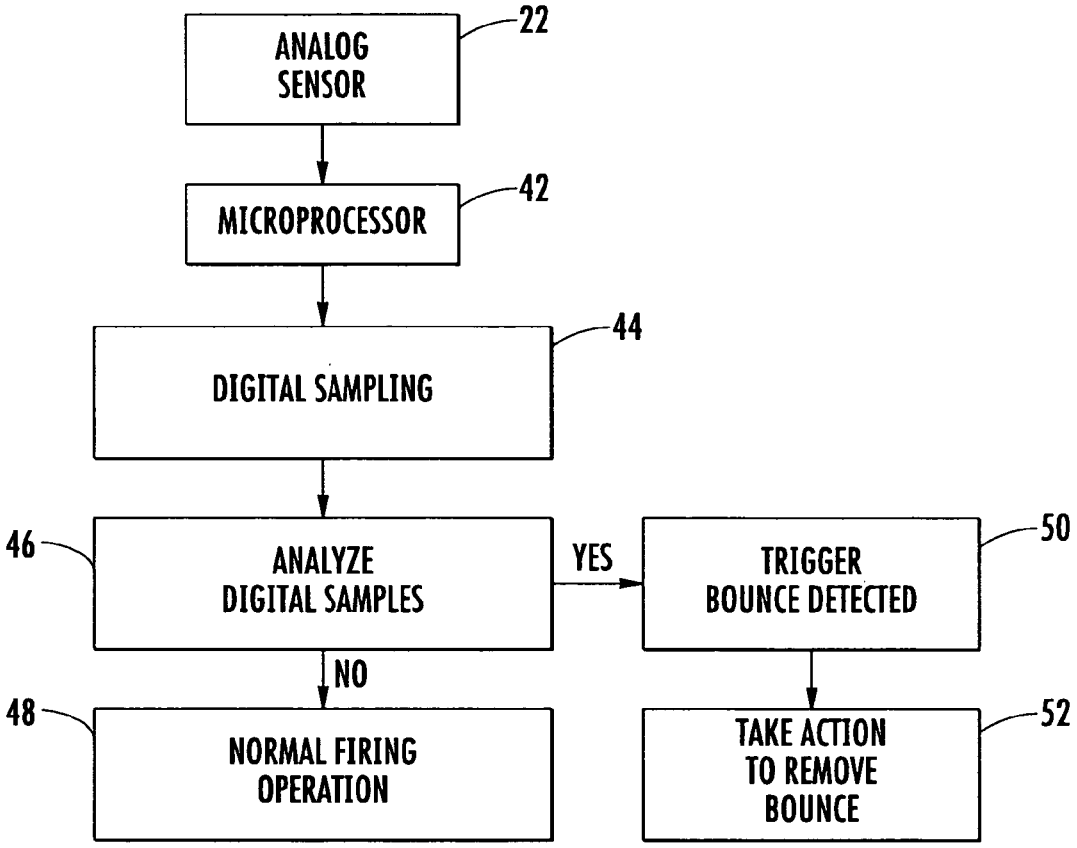
FIG. 3 is a flowchart illustrating the method of the present invention.

Referring first to FIG. 3, a flow chart of the general operation of the method of present invention is shown. Known paintball markers 10 include operating systems that control the entire operation of the marker 10, including firing timing, air pressure timing, bolt movement and paintball loading rates. The analog sensor 22 of the type shown in FIG. 2 sends a real-time analog signal to its output which is fed into a microprocessor 42, which typically runs the operating system of the marker 10. The analog signal is digitally sampled periodically at 44, such as at a rate of once every 120 microseconds. The digital sampling 44 is analyzed at 46 and if it appears to be a valid trigger profile, the marker 10 is permitted to operate normally at 48. However, if an abnormality is detected in the sampled signal, it is considered to be an invalid signal based on impermissible trigger bounce at 50 which could result in the marker 10 operating in an automatic mode. In this later case, a delay 52 after firing can be caused. Details of the operation of the method of present invention are set forth below.

Figure 4:
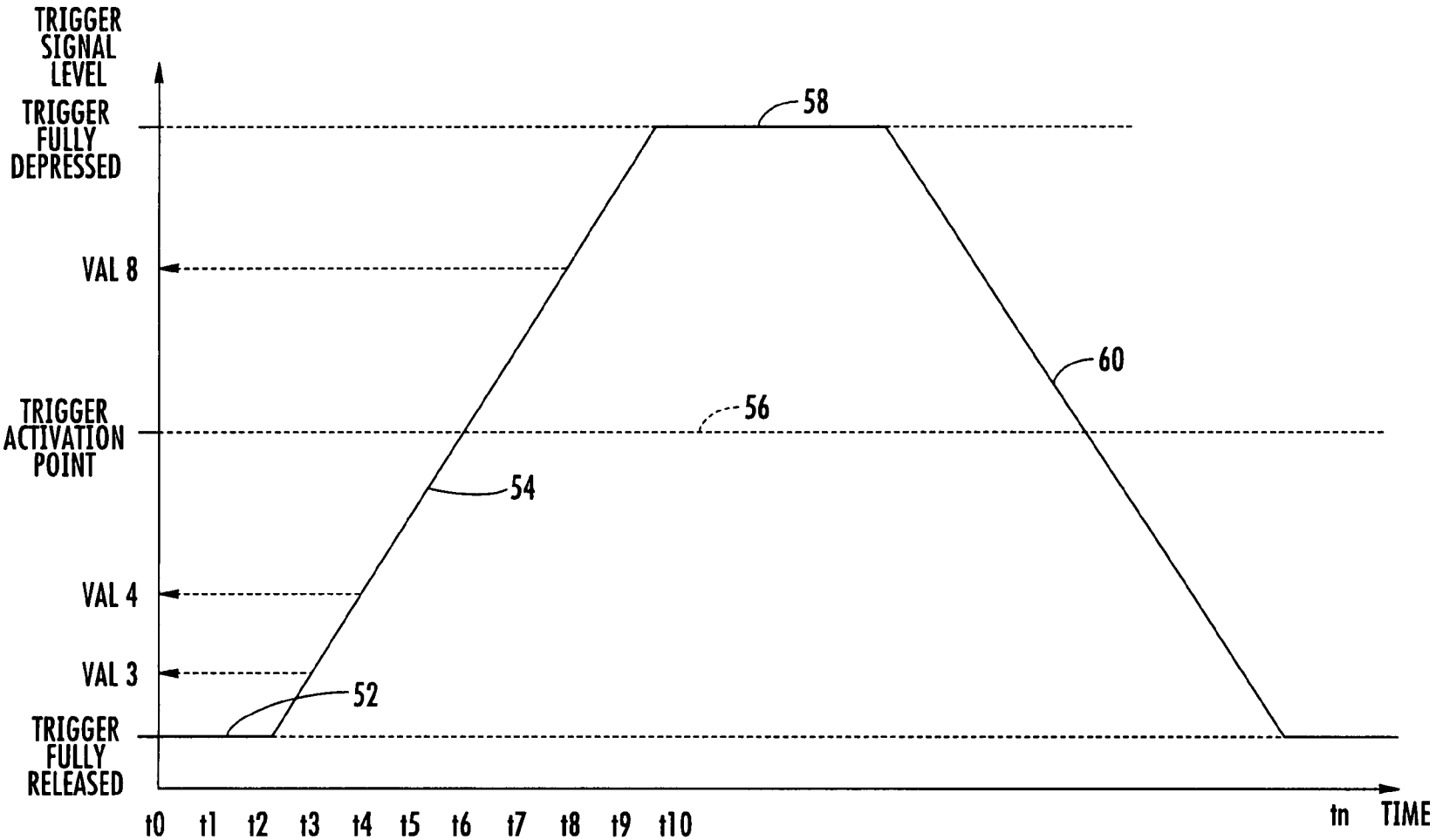
FIG. 4 is a graph of trigger position against time during a typical trigger pull and release using an analog sensor.

To understand the appearance of invalid trigger bounce signal, a valid signal must first be understood. FIG. 4 illustrates a graphical representation of a trigger position versus time resulting from a typical and valid trigger pull, which would not generate trigger bounce, is shown. At time t0, the trigger 18 is in a fully released, non-firing position so that the analog electrical signal of the sensor is at a low level 52. As the trigger is depressed at about t2, the signal rises at 54 as the trigger passes through the optical sensor 22 as more light is blocked by the prong 40 from reaching the light receiver 22*b*. When the trigger 18 reaches a trigger activation point or level 56 as it moves from LOW (at 52) to HIGH (at 58), the firing sequence can be initiated and a paintball 16 launched. By way of example, the trigger LOW level 52 can be 0 volts while the HIGH level 58 can be 5 volts. Of course, this depends on the sensor 22 used for a given marker 10.

Also, the trigger activation point 56 can be 50% (equating to about 2.5 volts, for example) of the overall travel or stroke of the trigger 18. The actual trigger activation point 56 can be programmed and set as desired.

Initiating a firing sequence based on the sensor 22 reaching a given point 56 is well known in the art and need not be further discussed herein. It should also be understood that a typical sensor 22 has a LOW signal 52 when the trigger is released and a HIGH signal 58 when the trigger is depressed. Certain sensors and the appropriate circuitry therefor can be designed for the opposite arrangement where a HIGH signal represents a trigger released condition and a LOW signal represents a trigger depressed condition. The method of the present invention can be modified to accommodate such a sensor.

Still referring to FIG. 4, when the trigger 18 is fully depressed representing a full firing position at about t10, the sensor 22 reaches a HIGH position 58. As the trigger 18 is released, the signal received by the sensor falls at 60 at a later position in time representing reversal of the position of the trigger 18. Typical marker software requires that the trigger 18 be released and then re-pulled to effectuate a another firing cycle.

As shown in the chart in FIG. 5, the microprocessor maintains a running log of the digitized sensor output over time which is analyzed in real-time. This is created by a real-time software loop which is constantly storing the value of the trigger position. A short time after the preset trigger activation point 56 is reached, a snapshot of the log of the sensor output is taken and then analyzed. During this analysis, the data from this table is passed through a trigger transition filter algorithm, which compares how the trigger has been pulled against user defined parameters to determine whether it is a valid signal or an invalid signal thereby representing a trigger bounce mode of operation.

Figure 6:
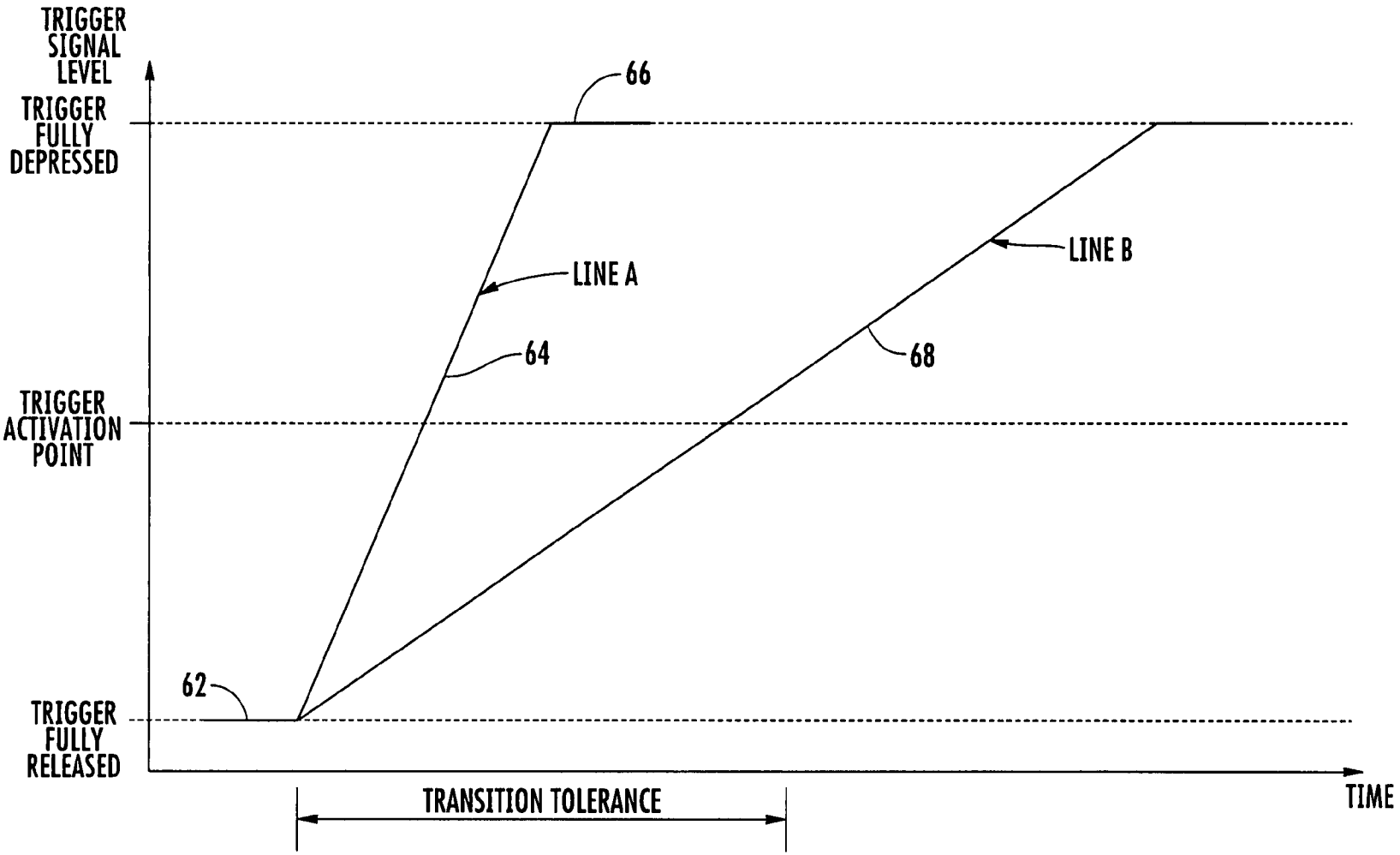
FIG. 6 is a comparative graph of trigger position against time for a valid trigger pull and an invalid trigger pull based on transition time.

In FIG. 6, the parameter of transition time from the trigger being fully released to the trigger being fully depressed is measured as a way to determine if trigger bounce is occurring. Line A represents a normal transition signal resulting from a normal trigger pull, such as the one shown in FIG. 4. Line A represents a trigger pull where the user intends to pull the trigger fully for the purpose of firing a single projectile. A valid trigger pull typically transitions via 64 from LOW 62 to HIGH 66 state in less than 5 milliseconds, such as in the range of 1–2 milliseconds.

In contrast, Line B represents a signal received from a trigger pull that has an unusually long transition time 68 from LOW 62 to HIGH state 66. A transition time that exceeds a preferred time of 10 milliseconds, indicates that the user is intentionally only partially pulling the trigger 18 for the purposes of exploiting the trigger bounce effect. This transition tolerance specifies the amount of time that the trigger can take to move past the optical sensor 22. The transition tolerance parameter can be set within the filtering software to be a given amount. If that amount is exceeded, the filtering software senses a trigger bounce condition. Thus, the present invention provides a HIGH pass-type filter to detect a trigger bounce condition.

Figure 7:
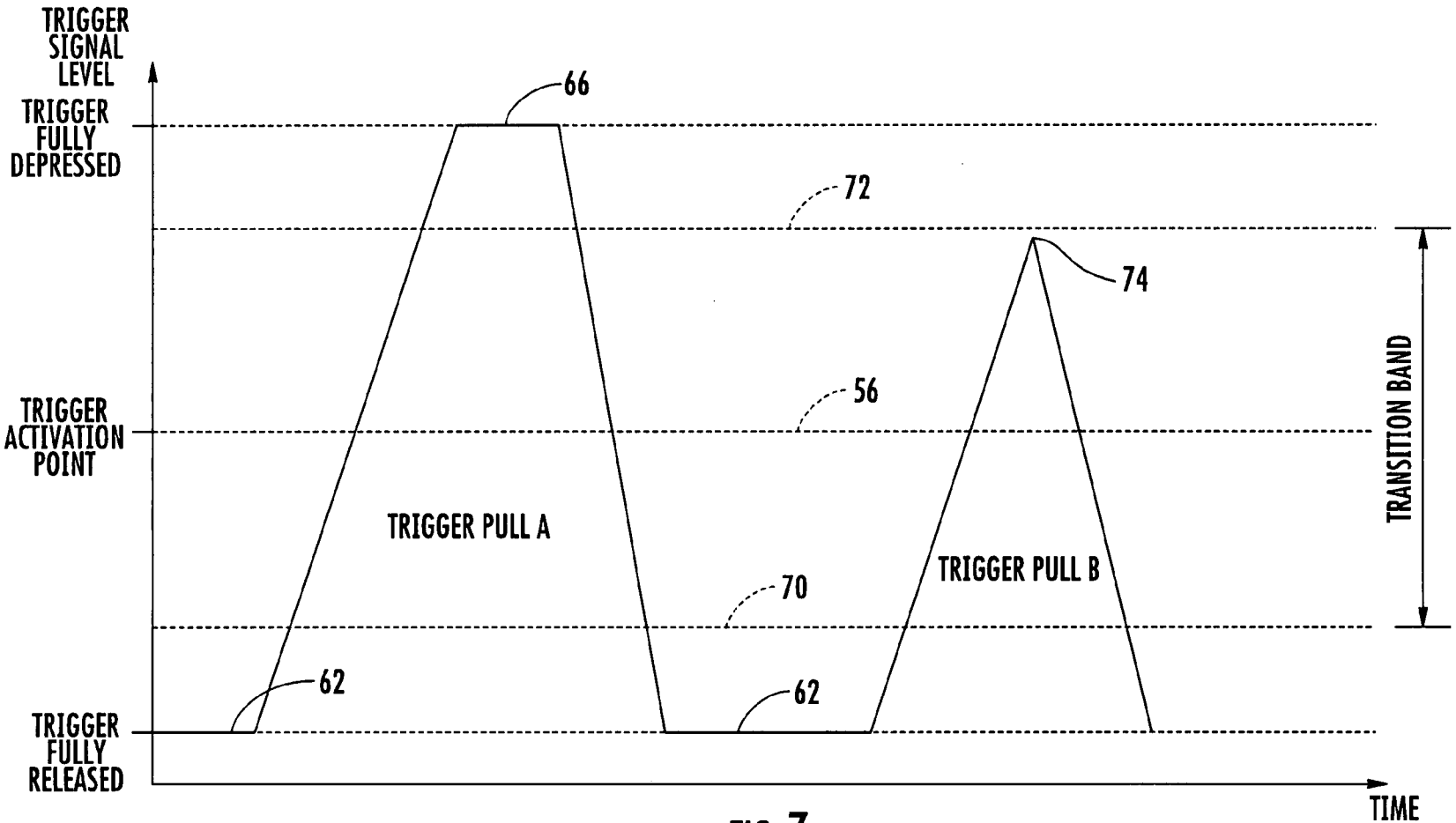
FIG. 7 is comparative graph of trigger position against time for a valid trigger pull and an invalid trigger pull based on stroke length.

Turning now to FIG. 7, another filtering parameter is shown in detail. The band parameter defines how far the trigger 18 must be depressed and how far it must be released before a trigger pull is considered a valid pull. In the example of FIG. 7, a the band parameter is set with 15% (at reference line 70) being a minimum release point and 85% (at reference line 72) being a minimum pull point. Pull represented by A is valid because the trigger 18 was released more than 15% (at reference line 70) and then depressed more than 85% (at reference line 72) thereby representing a full, valid trigger pull. On the other hand, trigger pull represented by B in FIG. 7 is invalid because although it starts below the release minimum 70 it fails to be depressed enough at 74 to exceed the minimum depression point at 85% (at reference line 72).

Still further, the method of the present can employ additional parameters for the purpose of setting forth a benchmark for determining when there is a trigger bounce operation. For example, minimum times can be set for the trigger to remain released or depressed. Referring back to FIG. 7, signal (at reference line 62) may be required to be LOW for a given period of time while the signal (at reference line 66) may be required to be HIGH for a period of time. For example, it may be required that the trigger 18 may have to be released or depressed for at least 10 milliseconds before another firing sequence can be initiated.

Figure 8:
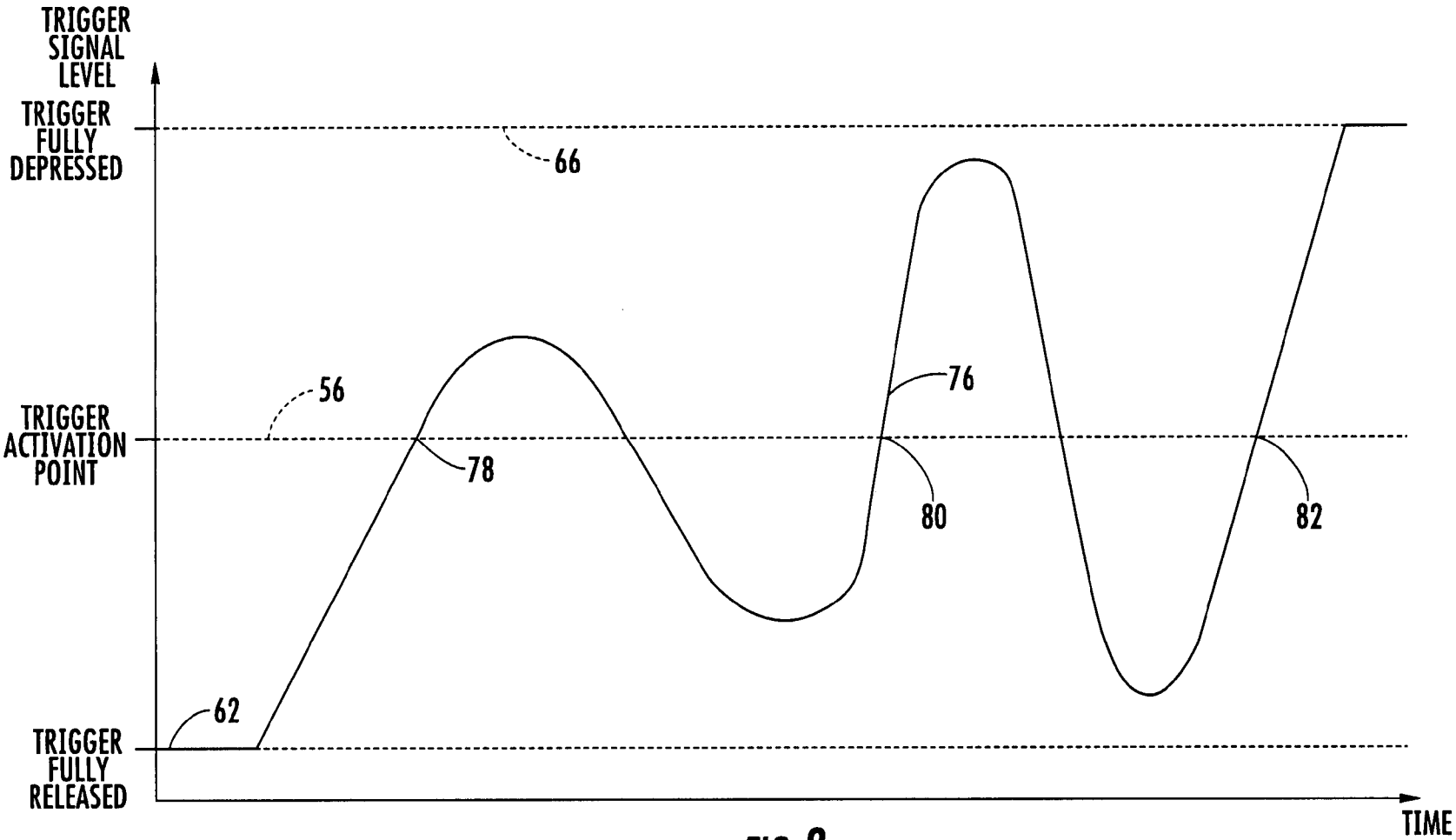
FIG. 8 is a graph of an invalid trigger pull based on oscillatory characteristics.

Turning now to FIG. 8, a typical signal of a trigger sensor 22, that is not being monitored and filtered by the method of present invention, is shown. This is a common trigger bounce signature, although, as can be understood, these signatures vary from marker to marker. As can be seen, the position of trigger 18 is hovering above and below the trigger activation line. Each time the line 76 passes above the activation line 56, another firing sequence is initiated. In the example shown in FIG. 8, three paintballs are launched, corresponding to transition points 78, 80 and 82 for only a single full pull of the trigger which occurred from LOW level 62 to HIGH level 66.

As the trigger bounce is allowed to continue over time, the more the trigger pulls resemble valid trigger pulls. However, if the signal of FIG. 8 was monitored and filtered using the method of the present invention, the signal would have been quickly determined to be invalid as a clear trigger bounce operation. For example, the signal of FIG. 8 transitions too slowly from a fully released condition at 62 to a trigger depressed condition at 66. Also, the stroke length of the trigger 18 is far too short as it hovers about the trigger activation line 56. Also, the signal does not remain long enough above and below the trigger activation line 56. When combined as desired, the various parameters can be set to eliminate the effect of recoil and trigger bounce on a paintball marker 10.

The trigger transition filter of the present invention can be easily incorporated into an existing operating system of a marker 10. Any algorithm can be employed to carry out the method of the present invention. Further, the filter at 46 of FIG. 3 of the present invention can be written in any language known in the art for easy incorporation into a marker operating system. The software that embodies the trigger transition filter of the present invention can be easily installed on a marker 10 by an upgrade. Moreover, once the software is installed on a marker 10, the parameters of the software, as described above, can be easily set for all competitors during a competition. For example, before a competition, the parameters for the match can be uploaded to the markers of the competitors to dictate the constraints on trigger bounce operation. Thus, the parameters of trigger bounce control and monitoring can be customized according the players and match at hand.

It would be appreciated by those skilled in the art that various changes and modifications can be made to the illustrated embodiments without departing from the spirit of the present invention. All such modifications and changes are intended to be covered by the appended claims.

What is claimed is:

1. A method of preventing trigger bounce during the launching of a projectile by a projectile launcher, comprising the steps of:

providing a projectile launcher having a trigger capable of actuating between a full non-firing position and a full firing position;

determining an amount of time for the trigger to normally transition from a full non-firing position to a full firing position;

providing a means for sensing position of the trigger;

sensing when the time for the trigger to transition from a non-firing position to a firing position exceeds the time for the trigger to normally transition from a full non-firing position to a full firing position; and delaying launch of a projectile for a predetermined period of time.

2. The method of claim 1, wherein the step of delaying launch of a projectile further includes the step of delaying acceptance of the trigger in a firing position for a predetermined period of time before launching a subsequent projectile.

3. The method of claim 1, further comprising the step of:

requiring movement of the trigger to a full non-firing position for a predetermined period of time.

4. The method of claim 1, wherein the means for sensing position of the trigger is an analog sensor that creates an analog signal indicative of positioning of the trigger.

5. The method of claim 4, wherein the analog sensor is an optical sensor.

6. The method of claim 1, further comprising the step of:

setting a triggering position between the full non-firing position and the full firing position.

7. A method of preventing trigger bounce during the launching of a projectile by a projectile launcher, comprising the steps of:

providing a projectile launcher having a trigger capable of actuating between a full non-firing position and a full firing position;

determining an amount of time for the trigger to normally transition from a full non-firing position to a full firing position;

providing an analog sensor for sensing position of the trigger and creating an analog signal indicative of positioning of the trigger;

analyzing position history of the trigger upon movement of the trigger to the triggering position between the full non-firing position and the full firing position.

8. The method of claim 7, further comprising the step of:

periodically sampling the analog signal to create a dataset of trigger position against time.

9. The method of claim 7, further comprising the step of:

requiring movement of the trigger to a full non-firing position for a predetermined period of time.

10. The method of claim 7, wherein the analog sensor is an optical sensor.

11. The method of claim 7, further comprising the step of:

setting a triggering position between the full non-firing position and the full firing position;

sensing oscillatory trigger movement between the triggering position and a non-firing trigger position.

12. The method of claim 8, wherein the step of periodically sampling the analog signal is periodically sampling the analog signal every 120 microseconds.

13. A method of preventing trigger bounce during the launching of a projectile by a projectile launcher, comprising the steps of:

providing a projectile launcher having a trigger capable of actuating between a full non-firing position and a full firing position;

providing a means for sensing position of the trigger;

sensing more than one partial actuation of the trigger that results in firing of a projectile; and, delaying launch of a projectile for a predetermined period of time.

14. The method of claim 13, further comprising the step of: requiring actuation of the trigger to a full non-firing position.

* * * * *